US006844039B1

(12) United States Patent
Kausch et al.

(10) Patent No.: US 6,844,039 B1
(45) Date of Patent: Jan. 18, 2005

(54) ELASTANE FIBER SPOOLS PROVIDED WITH A VARIABLE APPLICATION OF A PREPARATION

(75) Inventors: Michael Kausch, Köln (DE); Wolfgang Klein, Dormagen (DE); Christine Soenksen, Metelen (DE)

(73) Assignee: Bayer Faser GmbH, Dormagen (DE)

( * ) Notice: Subject to any disclaimer, the term of this patent is extended or adjusted under 35 U.S.C. 154(b) by 6 days.

(21) Appl. No.: 09/979,257

(22) PCT Filed: Jun. 5, 2000

(86) PCT No.: PCT/EP00/05117

§ 371 (c)(1),
(2), (4) Date: Nov. 20, 2001

(87) PCT Pub. No.: WO00/78658

PCT Pub. Date: Dec. 28, 2000

(30) Foreign Application Priority Data

Jun. 18, 1999 (DE) ..... 199 27 916

(51) Int. Cl.[7] ..... B32B 5/02; D02J 3/00

(52) U.S. Cl. ..... 428/36.3; 428/34.1; 428/35.7; 428/376; 428/377

(58) Field of Search ..... 428/36.3, 34.1, 428/35.7, 376, 377

(56) References Cited

U.S. PATENT DOCUMENTS 4,772,677 A * 9/1988 Kausch et al. ..... 528/61

5,560,558 A * 10/1996 Wray ..... 242/165

FOREIGN PATENT DOCUMENTS

DE 4 444 150 6/1995 ..... D01D/5/00

OTHER PUBLICATIONS

Patent Abstracts of Japan, Publication No. 63066073, Toray Du Pont KK.

Patent Abstracts of Japan, Publication No. 09301632, Nippon Ester Co Ltd.

* cited by examiner

*Primary Examiner*—Nasser Ahmad
*Assistant Examiner*—Marc Patterson
(74) *Attorney, Agent, or Firm*—Norris McLaughlin & Marcus PA

(57) ABSTRACT

The invention describes elastane packages on cylindrical tubes which are provided with a finishing oil content varying over the filament length, and a method for the production thereof. Instead of being applied uniformly along the filament, the finishing oil is distinctly increased on the outermost part, constituting in particular at least 3%, of the filament wound onto the tubes such that the oil coat in this region is at least 1.2 times higher than in the remaining region of the package. This gives rise to a finishing coat gradient of the package from the outside (high) inwards (low).

12 Claims, 5 Drawing Sheets

ELASTANE FIBER SPOOLS PROVIDED WITH A VARIABLE APPLICATION OF A PREPARATION

The invention relates to elastane packages on cylindrical tubes which are provided with a finishing oil content varying over the filament length, and to a method for the production thereof. Instead of being applied uniformly along the filament, this finishing oil is distinctly increased on the outermost part, constituting in particular at least 3%, of the filament wound onto the tubes such that the oil coat in this region is at least 1.2 times higher than in the remaining region of the package. This gives rise to a finishing coat gradient of the package from the outside (high) inwards (low).

Elastane filaments or elastanes are understood to be fibres or filaments at least 85 wt. % of which consist of segmented polyurethanes or polyurethane carbamides. The elastic and mechanical properties of such fibres are achieved by using, for example, polycarbamide-polyurethanes of aromatic diisocyanates to produce the elastane filaments. Elastanes of this kind are usually produced by spinning solutions according to the wet spinning method or, preferably, according to the dry spinning method. Polar solvents, e.g. dimethylsulphoxide, N-methyl pyrrolidone, dimethylformamide or, preferably, dimethylacetamide are suitable solvents for both methods.

Commercial yarns produced from such fibres have been known for many years. The function of these fibres as elasticizers for underwear, support garment and bathing wear materials and their application in hosiery bands, sock tops or elastic tape represent the most important fields of application.

In order that these goods may be produced to a high quality, the elastane packages used in this respect must fulfil important minimum requirements:

As dry-spun elastane fibres themselves have a very tacky surface, steps must be taken to ensure that the filaments wound onto tubes easily separate from the package again and run uniformly through all deflection members of the processing machine. For this purpose an antiblocking agent, usually in the form of alkaline earth metal soaps, must be added to the spinning material during the actual spinning process (see U.S. Pat. No. 4,296,174). The filament is also provided with lubricants such as, e.g. silicone oils, usually during winding. The simultaneous application of lubricants and antiblocking agents (cf. U.S. Pat. No. 3,039,895) to the elastane filament has also been described.

The introduction of antiblocking agents or the application of silicone oil acting as lubricant to the elastane filament must be carried out in a highly uniform fashion in order to ensure that the filament is equally tacky (adhesive) at each point of its travel on the package both with respect to the filament layers on the package, from which it must separate, and with respect to the filament guide members of the processing machines. With regard to a uniform oil coat, in JP 63-66073 Maruyama et al even go so far as also to take account of the varying elongation of the elastane filament inside the package when applying the oil.

The publication U.S. Pat. No. 3,296,063, for example, describes the polysiloxanes which are particularly suitable lubricants for elastane filaments. The quantity of oil coat is of the order of magnitude of 2% to 10% of the total weight of the elastane filament.

In the common dry spinning method, according to which elastanes are in most cases produced, the oil is applied directly below the spinning chamber either by immersion, spraying or through contacting a filament guide or a roll.

An improvement on this standard method is described by the patent specification U.S. Pat. No. 5,560,558.

In order to increase reliability in the processing of elastane packages, this publication proposes just providing the last 100–500 m of wound elastane filament on each package with a distinctly lowered oil coat, so that the filament adheres better to its supporting surface in the outer layer of the package and as a result the top layers do not decline over the package shoulders.

However it has now surprisingly been found that there are important fields of application in elastane processing which require a type of package which is built up in a manner opposite to that described in U.S. Pat. No. 5,560,558.

One of the most important fields of application for elastane fibres lies in their use in pantyhose bands. Filament thicknesses ranging from 133 dtex to 270 dtex are usually used here.

In order to guarantee the high requirements regarding pay-off properties which are to be fulfilled in the hosiery industry, this manufacturing branch uses pineapple packages with precision winding. Such special packages are not usually produced directly following the elastane dry spinning process; a stable package with random winding which is sufficient for most forms of processing and can be produced inexpensively is manufactured at this point. However the filament must then be rewound from the random-wound package to a precision-wound one in a second expensive manufacturing step for the hosiery industry.

One possible way of avoiding this second expensive manufacturing step is to use the digicone method (Melliand Textilbreichte 6, 1985, p. 408), which is integrated into a winding device mounted directly below an elastane dry spinning chamber.

However if this method is employed, an oil coat is applied as usual in the elastane industry and the pineapple precision packages thus produced are used to produce pantyhose bands, the results obtained are found to be unsatisfactory. The pantyhose bands produced from the outer layer of a package of this kind are distinctly narrower than those originating from material from the interior of the package. These differences in band widths (usually called "table dimension" in the hosiery industry) are so great (>0.5 cm) that further processing of the pantyhose under the same conditions becomes impossible. A particularly vexing factor is that this adverse effect is distinctly intensified if the packages are stored for a lengthy period before processing, which is usually the case on the route from the elastane producer to the processor. Table dimension differences between inner and outer layer of up to 2 cm may occur following a storage period exceeding approximately 2–3 weeks.

It has surprisingly been found that this disturbing effect can be prevented by distinctly increasing the finishing coat on the outermost part of the filament length, constituting at least 3% of the latter, of the filament wound onto the tubes in the outer layer of an elastane package, in particular a pineapple elastane precision package produced according to the digicone method, such that the oil coat in this region is at least 1.2 times higher than in the inner region of the package.

The subject of the invention lies in elastane packages on cylindrical tubes, consisting of elastane filaments provided with a finishing oil by way of an outer coat, characterised in that the finishing oil content is increased on the outermost part, constituting at least 3%, preferably at least 5%, with at least 10% being particularly preferred, of the elastane filament wound onto the tubes such that the content of finishing oil applied to the filament surface in this region constitutes at least 1.2 times, preferably 1.5 times the content of the finishing oil on the surface of the filaments in the inner region, in particular in the region of the part of the innermost package filaments constituting at least 20%.

The elastane package is preferably a pineapple elastane precision package produced according to the digicone method.

The content of finishing oil on the outermost part of the package is increased in a preferred form with respect to the part of the innermost package filaments constituting at least 30%.

The elastane filaments of the package have in particular a total titre of 100 to 350 dtex, preferably of 130 to 270 dtex.

Particularly preferred are elastane packages in which the content of finishing oil applied to the surface of the filaments in the outermost part of the filament length, constituting at least 3%, remains increased over a period of at least 25 days, in particular at least 55 days, after producing the packages with respect to the inner part of the filament length constituting in particular at least 20%.

The following are preferably used as finishing oils:

Polysiloxanes, polyalkylsiloxanes and/or alkoxylated polysiloxanes, in particular polydimethylsiloxane and/or ethoxylated polydimethylsiloxane with a viscosity of 2 to 100 mPa.s (at 25° C.), in particular of 2.5 to 50 mPa.s (at 25° C.), with 2.5 to 30 mPa.S (at 25°) being particularly preferred, or mineral oil with a viscosity of 2 to 2500 mPa.s (at 25° C.), in particular of 2.5 to 2000 mPa.s (at 25° C.), with 3 to 1500 mPa.S (at 25°) being particularly preferred, or any desired mixture of the above mineral oils and poly(alkyl)siloxanes.

Other additives which are basically known, such as metal soaps active as antiblocking agents, e.g. of higher fatty acids such as Mg stearate, antistatic agents and/or dispersing auxiliaries, may be added to the finishing oils described above.

A further subject of the invention is a method for producing the elastane packages according to the invention through spray finishing, a one-way finish or a coat of finishing oil by means of finishing rolls, characterised in that, when applying the finishing oil to the elastane filament to be wound onto a package, the outer 3%, preferably 5%, in particular 10% of the filament intended for the outer layer of the package is provided with at least 1.2 times the content of finishing oil as the innermost part of the package, in particular the part of the filament constituting at least 20% of the package, by increasing the feed of finishing oil to the filament.

A preferred method is characterised in that the finishing oil is applied directly after the elastane filaments have been spun, in particular in the lower region or at the outlet of the spinning chamber.

The use of the elastane packages according to the invention to produce underwear, support garment and bathing wear materials and to produce hosiery bands, sock tops or elastic tape is a further subject of the invention.

The method employed to increase the oil coat on the last, at least 3% of the elastane filament would onto the tube depends on the oil application technique which is used. If, for example, a spray method is used to spray on the oil, a valve which regulates the oil supply to the spray device is opened slightly wider in the filament region in question.

The procedure is similar when using a roll, also called a finishing godet or roller, to apply the oil. The roll dips by way of its underside into a trough which is always filled with finishing liquid, e.g. by continuously supplying oil to the trough. The roll is rotated to wet it with oil; the faster the roll rotates, the more oil it takes up. The elastane filament itself is guided at a constant speed and tension, usually directly below the spinning chamber outlet or also after the first deflection via a godet past the finishing roll in contact with the latter and takes up varying quantities of oil, according to the rotational speed of the roll. In order to increase the oil coat by a factor of 1.5 in the outer layer of the package, the rotational speed of the finishing godet in this method must be increased at least by a factor of 2 with respect to the speed of the roll when finishing the inner layers. A detailed description of the preferred procedure can be found in the Examples.

Finishing rolls for the roll coating process may be smooth or fluted according to generally known arrangements.

A further method for applying finishing oil lies in the one-way finish.

The filament is guided over a pin or shoe comprising one or more holes for supplying finishing oil. The oil is applied to the filament through the contact with the pin/shoe.

The finishing methods are basically known per se and represented, for example, in B. v. Falkai, "Synthesefasern", p. 111 et seq., publ. Chemie, Weinheim 1981.

The following method, for example, is used to determine whether the desired oil coat according to the invention has been achieved:

The finishing coat of the fibre samples is determined by means of a pulse NMR device QP 20+ produced by Oxford Instruments. In this case the resonance signal of the protons in the liquid phase of a solid-liquid mixture is used for the quantitative determination of the liquid phase.

The device must firstly be calibrated when this method is employed. For this purpose elastane filaments spun without finish are well wetted with varying quantities of finishing oil and the quantity applied is in each case established by weighing, after which the NMR measurement is carried out. This is performed 10 to 12 times within the measuring range to be expected and a calibration curve is thus obtained.

An individual calibration curve must be plotted for each finishing oil applied and each elastane type (e.g. polyester or polyether elastane) used.

For the actual measurement approximately 0.8 to 2.0 g of filament material, according to the package meters indicated in the Figures, are taken from the package, placed in a small glass tube of a diameter of 16 mm and measured without further pretreatment by means of the Hahn echo pulse method. 20 FIDs are added for one finish determination.

It is important to carry out these measurements within the first four days following the production of the spun packages, as diffusion effects within the package cause a shift in the oil contents between inner and outer layer with time.

The digicone method may be used instead of the conventional operation as a result of the finishing coat according to the invention, modified with respect to the prior art: Production of the primary package with random winding and subsequent rewinding to form the pineapple precision package, without a processing hosiery band producer being disadvantaged due to significantly fluctuating pantyhose band widths (table dimensions).

The invention is described in detail by way of example in the following using the Figures, in which.

EXAMPLES

Figure 1:
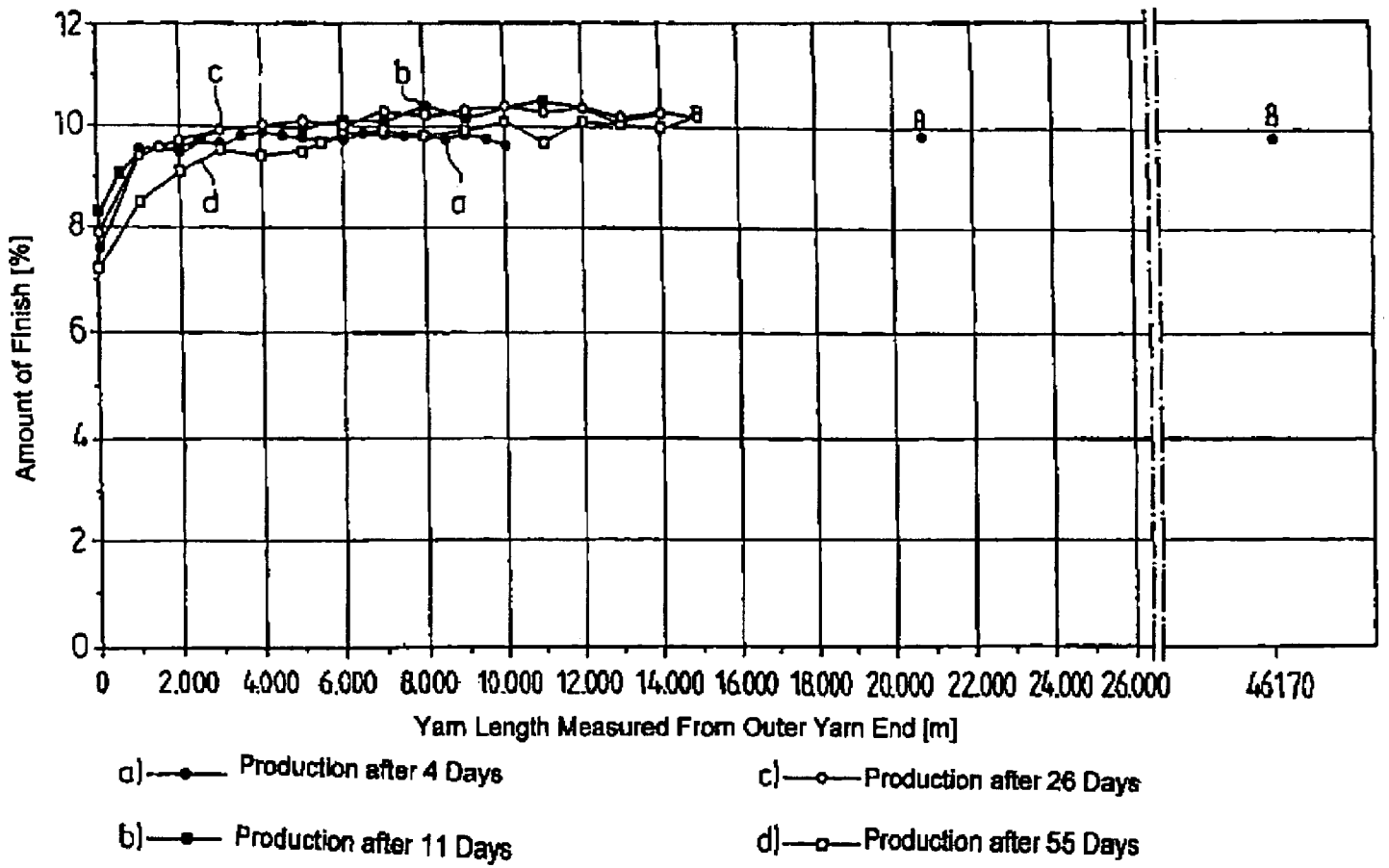
FIG. 1 is a graph of the content of finishing oil as a function of the filament length with regard to four conventional packages (titre 195 dtex) stored for different periods

The following examples describe the production of the elastane packages according to the invention, proving the advantageous effect in the further processing to form pantyhose bands.

Production of the Raw Fibrous Material:

In all examples the packages were produced from an elastane polymer which was synthesised from a poly (tetramethylene ether)glycol of a molecular weight of 2000, capped with methylene-bis(-4-phenyldiisocyanate) ("MDI") and chain-lengthened with a mixture of ethylenediamine (EDA) and diethylamine (DEA). The synthesis method was the same for all examples:

44.9 parts by weight of polyetherdiol of a molecular weight of 2000 are mixed with 8.9 parts by weight of MDI and 31 parts by weight of dimethylacetamide, heated to 50–55° and maintained at this temperature for 95 min. in order to obtain an isocyanate-capped polymer with a NCO content of 2.10%

In order to produce the polurethane carbamide, a solution of 171.4 parts DMAC, 0.97 parts EDA and 1.385 parts of a 10% solution of DEA in dimethylacetamide as well as 0.00042 parts of the dye Makrolexviolett B (Bayer AG) is firstly cooled to 25° and made available. 1.1 parts of dry ice in pellet form may also be added to this mixture in order to slow down the reaction rate. The previously produced prepolymer, likewise already cooled, is now added to this mixture while stirring vigorously, so that a solution of the polyurethane carbamide in DMAC with a solids content of 22% is obtained. Hexamethylene diisocyanate (HDI) is added to adjust the molecular weight of the polymer such that the solution finally has a viscosity of 70 Pa.s/25° and an inherent viscosity of $\eta_{inh}$=1.21 dl/g.

Following the production of the polymer as described in the above section, a stock formulation of additives is admixed with the latter, this formulation consisting of 0.52 parts of Cyanox 1790 (1,3,5-tris(4-t-butyl-3-hydroxy-2,6-dimethylbenzyl)-1,3,5-triazine-2,4,6-(1H,3H,5H)trione, a stabilizer produced by Cytec Industries) and 4.7 parts of DMAC. 0.5 parts of a 40% solution of a reaction product of 4-methyl-4-aza-heptanediol-2,6 with Desmodur W in dimethylacetamide are added as a further additive.

A second stock formulation is now admixed with this spinning solution, this consisting of 22.75 parts of a 42% suspension of titanium dioxide type RKB 2 (Bayer AG) and 7.75 parts of a 30% spinning solution, such that a titanium dioxide content of 0.1 wt. %, related to the polyurethane carbamide polymer, results in the finished filament A further stock formulation is now admixed with this spinning solution. This consists of 14.3 parts of a 22% spinning solution, 14.2 parts of a 11.4 wt. % suspension of Mg stearate and 1.62 parts of an ethoxylated polydimethylsiloxane, Silwet L 7607 produced by Witco Surfactants. The formulation is metered into the polymer solution to be spun such that the Mg stearate content in the finished fibre is 0.4 wt. %.

Rewinding into a Precision Winding

Rewinding from random-wound cylindrical packages into precision-wound pineapple packages takes place by means of a 5-position Conorapid winding machine of an average pay-off speed of 550 m/min. Doffing takes place overhead, the material being wound onto 160×73 mm tubes.

Production of Pantyhose Bands and Measurement of Pantyhose Band Widths (Table Dimensions)

The pantyhose bands are produced on a 4-system Lonati knitting machine of type 301. The base material used is a polyamide 44 dtex f 13 with a bond number of 3:1. A knitting machine speed of 400 rpm is used for processing. The elastane filament is passed via a Plasmeca type tension regulator before entering the knitting machine, according to the titre used. The setting of the filament brake for elastanes with the titres each indicated on the left is:

| | |
|---|---|
| Dtex 150 | 3.2 |
| Dtex 195 | 3.6 |
| Dtex 230 | 3.8 |
| Dtex 270 | 4.0 |
| Dtex 320 | 4.0 |

5 hose are produced from each trial setting and the band widths then measured in the relaxed state. The band dimensions determined from these 5 measurements are called the table dimension and represent an important processing criterion for the further-processing hosiery industry. "Table dimension, outside" means the knitted hose were produced from the outer package layer, "table dimension, centre" means that the hose were produced from package material which had been paid off to approximately half the package weight and "table dimension, inside" means that the hose were produced from elastane coming from packages having been paid off to approximately 100 to 150 g of the package weight.

Example 1

(Standard Method, Not According to the Invention)

The elastane spinning solution described above is spun by means of the dry spinning method into a filament of thickness 195 dtex. For this purpose the spinning solution is forced through a nozzle with 24 holes of a diameter of 0.3 mm and dried in a 5 m long spinning chamber, which is heated from outside to 230° and also charged from above with hot air at approximately 390°. The 24 individual filaments resulting from this process are combined to form a coalesced filament yarn by means of a twist member mounted below the chamber mouth. This yarn, which is drawn out of the chamber at a constant speed by means of a deflection godet of a rotational speed of 480 m/min and provided via a roll finish (diameter of roll 8 cm, rotational speed: 20 rpm) with the silicone oil Baysilone M 20 and then wound up on a SSM-digicone winding device produced by Schweiter according to the digicone method described in Melliand-Textilberichte 6, 1985 page 408 et seq. and at a winding speed of 540 m/min. In order to produce a package weighing, e.g. 1 kg, spinning is carried out in this way for 95 min., after which the filament movement is interrupted, the full package removed, a new empty tube placed on the winding mandrel and the filament applied. Timing recommences and the winding process starts again.

Pantyhose bands are then produced from the filaments and the appurtenant table dimensions determined as described in the preceding section. A measurement is also taken of the finishing coat along the filament wound onto the package (see FIG. 1). The value which is in each case furthest to the right in the graphs (FIGS. 1 to 5) denotes the oil coat in the region of the filament length which corresponds to approximately 100 g of remaining winding on the package.

FIG. 1 reproduces the finishing oil distribution after 4 days, 11 days, 26 days and 55 days as a function of the filament length for different packages produced in the same way.

| | Outside | Centre | Inside |
|---|---|---|---|
| Table dimension after 1 day package storage period | 11.0 cm | 11.6 cm | 11.6 cm |
| Table dimension after 26 day package storage period | 10.8 cm | 11.6 cm | 11.6 cm |

In this case the oil coat in the first 2000 m is distinctly lower than in the inner package layer, in the further outer package layer of the same order of magnitude as in the inner package layer (see FIG. 1), and table dimension differences exceeding 0.5 cm between hosiery bands of elastanes of the inner and outer layer are measured both after a short (1 day) and a longer (26 day) package storage period, which means that this product cannot be satisfactorily further processed at any time.

Example 2

(According to the Invention)

An elastane package of a filament fineness 195 dtex is produced as described in Example 1. However this time the finishing godet speed is set to 10 rpm for 80% of the package running time and to 28 rpm for the last 20% of the package running time. If, for example, the aim is to produce packages weighing 1050 g, this means that the finishing godet must be rotated for 80 minutes at 10 rpm and then for 19 minutes at 28 rpm. The packages are then removed and the operation restarted. The oil coat in the outermost 15000 package meters is between 13% and 19% of the total weight of the package and in the inner layer approximately 7% of the total weight of the package, according to the period over which the package is at rest.

Figure 2:
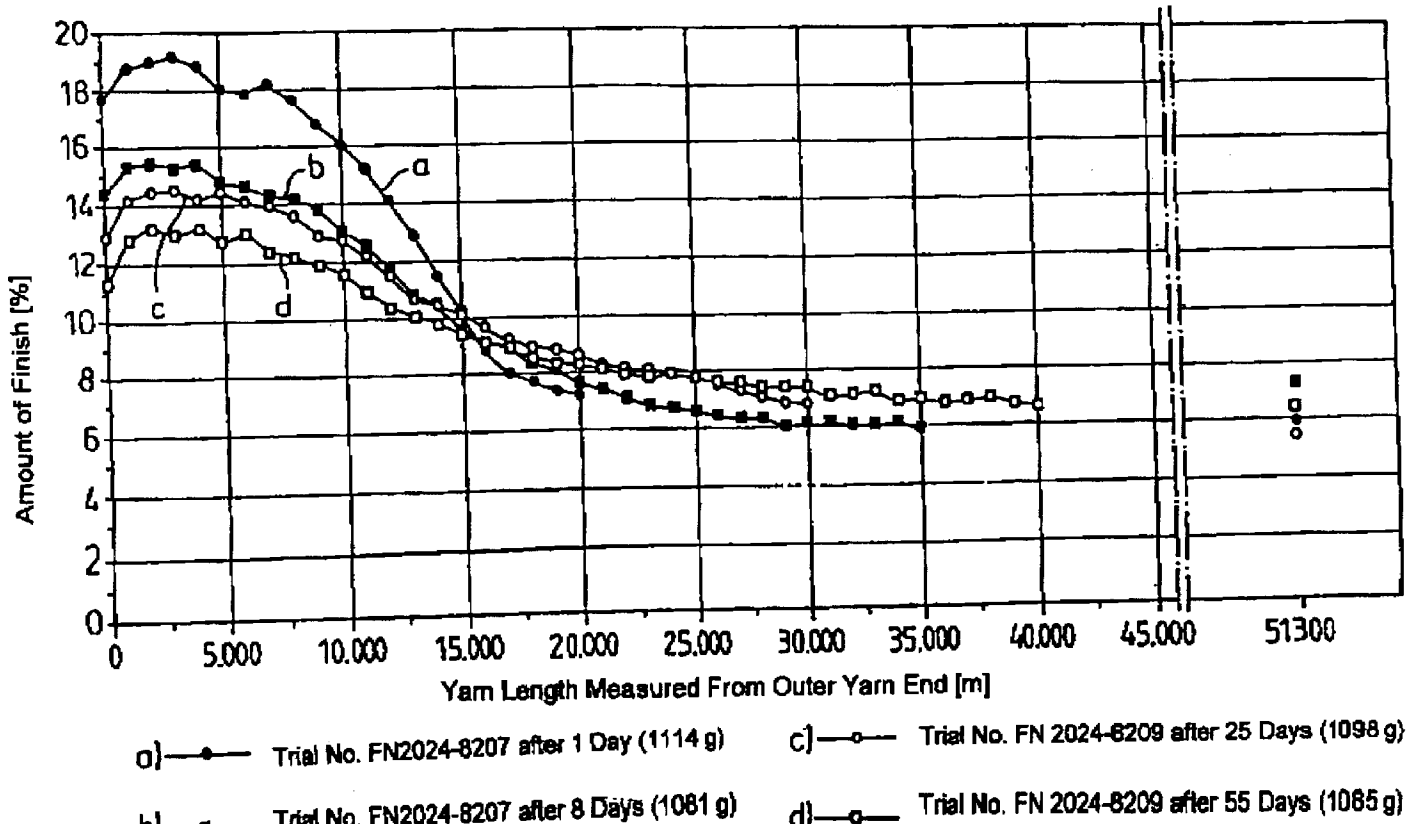
FIG. 2 is a graph as in FIG. 1, although determined with four packages according to the invention (titre 195 dtex)

The oil coat quantities reproduced in FIG. 2 are then measured along the run of the filament following the storage periods indicated in this Figure.

The table dimensions resulting when the packages are knitted after different storage periods are indicated in the following table:

| | Outside | Centre | Inside |
|---|---|---|---|
| Table dimension after 1 day package storage period | 11.4 cm | 10.9 cm | 10.9 cm |
| Table dimension after 7 day package storage period | 11.2 cm | 11.2 cm | 11.1 cm |
| Table dimension after 25 day package storage period | 11.2 cm | 11.1 cm | 11.2 cm |
| Table dimension after 60 day package storage period | 11.1 cm | 11.2 cm | 11.2 cm |

It can be seen that the table dimension differences between inner and outer layer are only 0.5 cm after storing the package for just one day. In contrast to the packages described in Example 1 (comparison), the table dimension is initially greater upon processing the elastanes of the outer package layer in comparison with elastane material of the inner layer. It approaches the table dimension of the elastane material of the inner layer when the package is stored for a longer period. What is even more important is that these differences only amount to 0.1 cm after storage periods exceeding one week, as occur in practice between production of the package and processing by the customer. This means that the quality of the package improves the longer the period over which it is stored.

Example 3

(According to the Invention)

An elastane package of fineness 195 dtex is produced as described in Example 1. This time the finishing godet speed is set to 9 rpm for 80% of the package running time and to 31 rpm for the last 20% of the package running time. If, for example, the aim is to produce packages weighing 1050 g, this means that the finishing godet must be rotated for 80 minutes at 9 rpm and then for 19 minutes at 31 rpm. The packages are then removed and the operation restarted.

Figure 3:
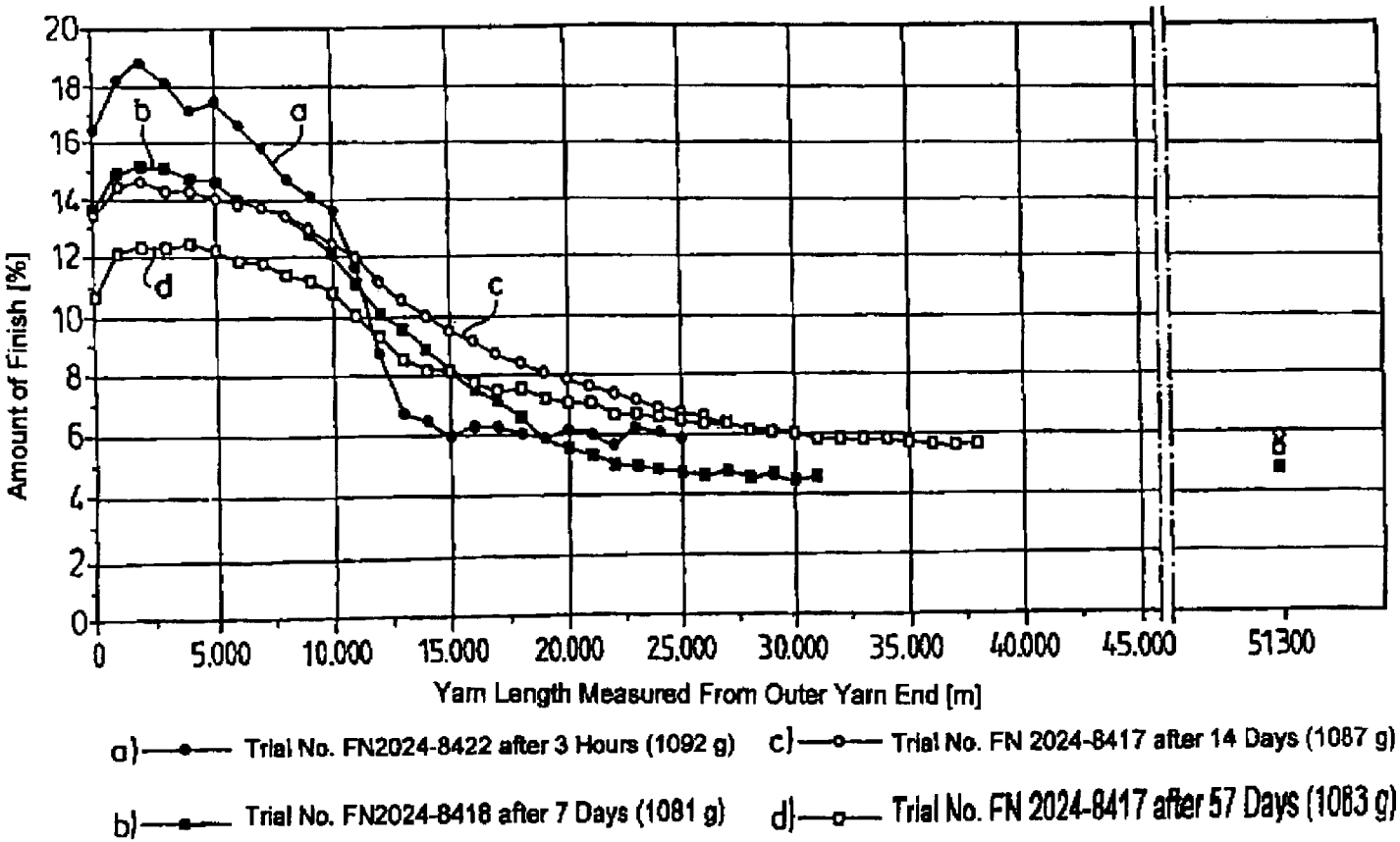
FIG. 3 is a graph as in FIG. 2 with four packages according to the invention (titre 195 dtex)

The oil coat quantities reproduced in FIG. 3 are then measured along the run of the filament following the indicated package storage periods for different packages. The oil coat in the outermost 10000 package meters is between 11% and 19% and in the inner layer approximately 5%, according to the period over which the package is at rest.

The table dimensions resulting when the packages are knitted after different storage periods are indicated in the following table:

| | Outside | Centre | Inside |
|---|---|---|---|
| Table dimension after 3 hour package storage period | 11.7 cm | 11.0 cm | 11.0 cm |
| Table dimension after 7 day package storage period | 11.1 cm | 11.0 cm | 11.2 cm |
| Table dimension after 14 day package storage period | 11.0 cm | 11.1 cm | 11.0 cm |

It can be seen that here too the table dimension differences between inner and outer layer are only 0.1 cm at most after storage periods exceeding one week, as occur in practice between production of the package and processing by the customer.

Example 4

(According to the Invention)

An elastane package of fineness 195 dtex is produced as described in Example 1. This time the finishing godet speed is set to 10 rpm for 90% of the package running time and to 22 rpm for the last 10% of the package running time. If, for example, the aim is to produce packages weighing 1050 g, this means that the finishing godet must be rotated for 90 minutes at 10 rpm and then for 9 minutes at 22 rpm. The packages are then removed and the operation restarted.

Figure 4:
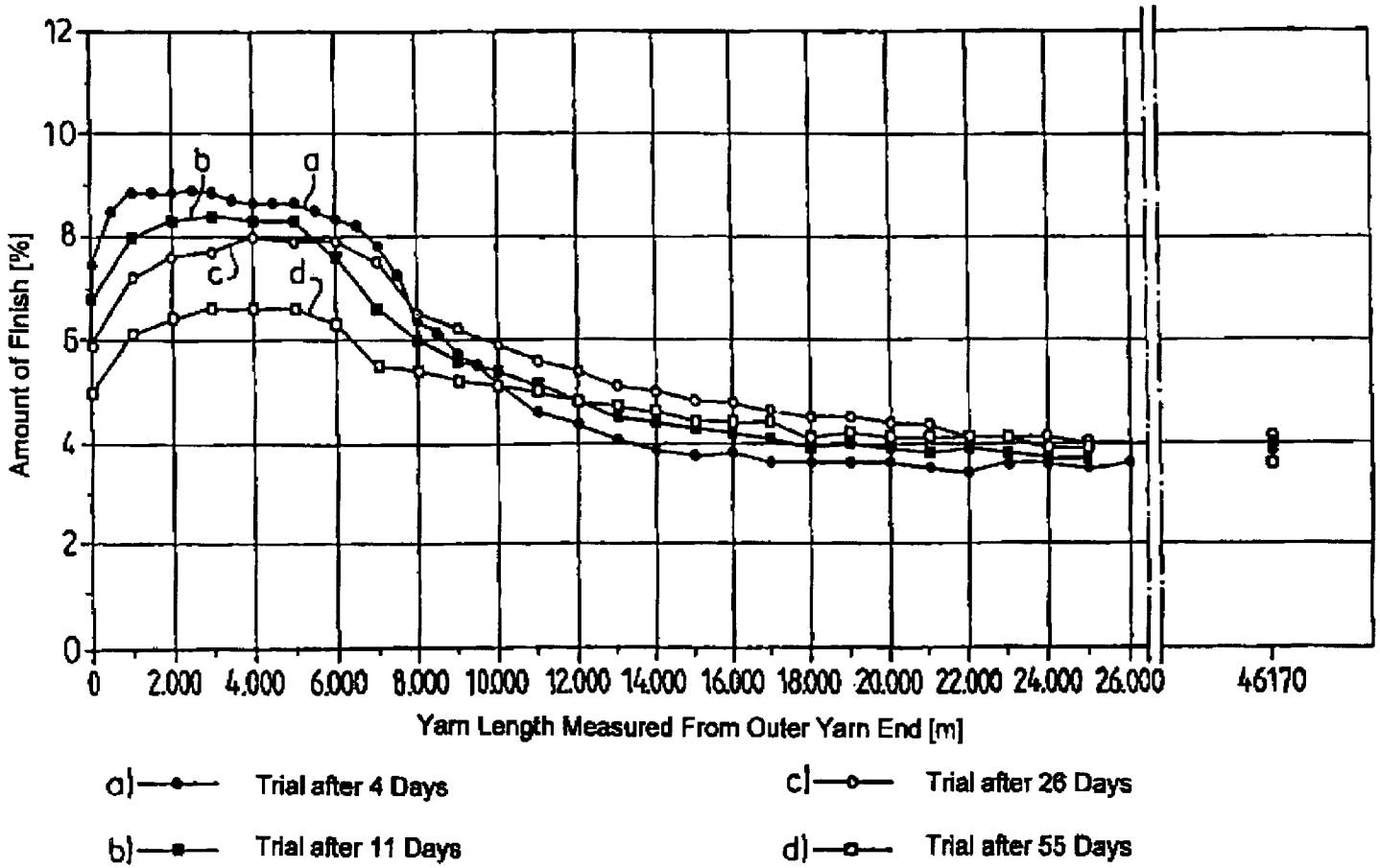
FIG. 4 is a graph as in FIG. 2 with four packages according to the invention (titre 195 dtex)

The oil coat quantities reproduced in FIG. 4 are then measured along the run of the filament following the package storage periods indicated in this Figure. The oil coat in the outermost 10000 package meters is between 5% and 9% and in the inner layer approximately 4%, according to the period over which the package is at rest.

The table dimensions resulting when the packages are knitted after different storage periods are indicated in the following table:

| | Outside | Centre | Inside |
|---|---|---|---|
| Table dimension after 1 day package storage period | 11.0 cm | 10.9 cm | 11.0 cm |
| Table dimension after 11 day package storage period | 10.8 cm | 11.0 cm | 11.1 cm |
| Table dimension after 26 day package storage period | 10.5 cm | 11.0 cm | 11.0 cm |

It can be seen that the table dimension differences between inner and outer layer are between 0.3 and 0.5 cm after storage periods exceeding one week, as occur in practice between production of the package and processing by the customer, these being values which are still tolerable for regular processing and correspond to the prior art where a rewound article is concerned. However the expensive rewinding process is not performed here.

Example 5

(Not According to the Invention; Corresponding to U.S. Pat. No. 5,560,558)

99.5% at 20 rpm, 0.5% at 0 rpm

If, for example, the aim is to produce packages weighing 1050 g, this means that the finishing godet must be rotated at 20 rpm and the finishing roll must be stopped 30 seconds before the calculated end of the package running time of 99 minutes, so that no more finish is applied to the last filament meters. The packages are removed at the end of the package running time and the operation can be restarted.

| | Outside | Centre | Inside |
|---|---|---|---|
| Table dimension after 4 day package storage period | Filament breakages | 11.5 cm | 11.5 cm |

No hosiery bands could be produced from the outer package layer in this trial, as the elastane filament continuously broke upon entering the hosiery knitting machine. Therefore no further trials with packages produced in this way were started.

Example 6

(Comparison, Prior Art)

An elastane package of fineness 195 dtex is produced as described in Example 1. However this time the package is rewound after being produced, as described in the section "Rewinding into a precision winding", and only then is it processed.

Figure 5:
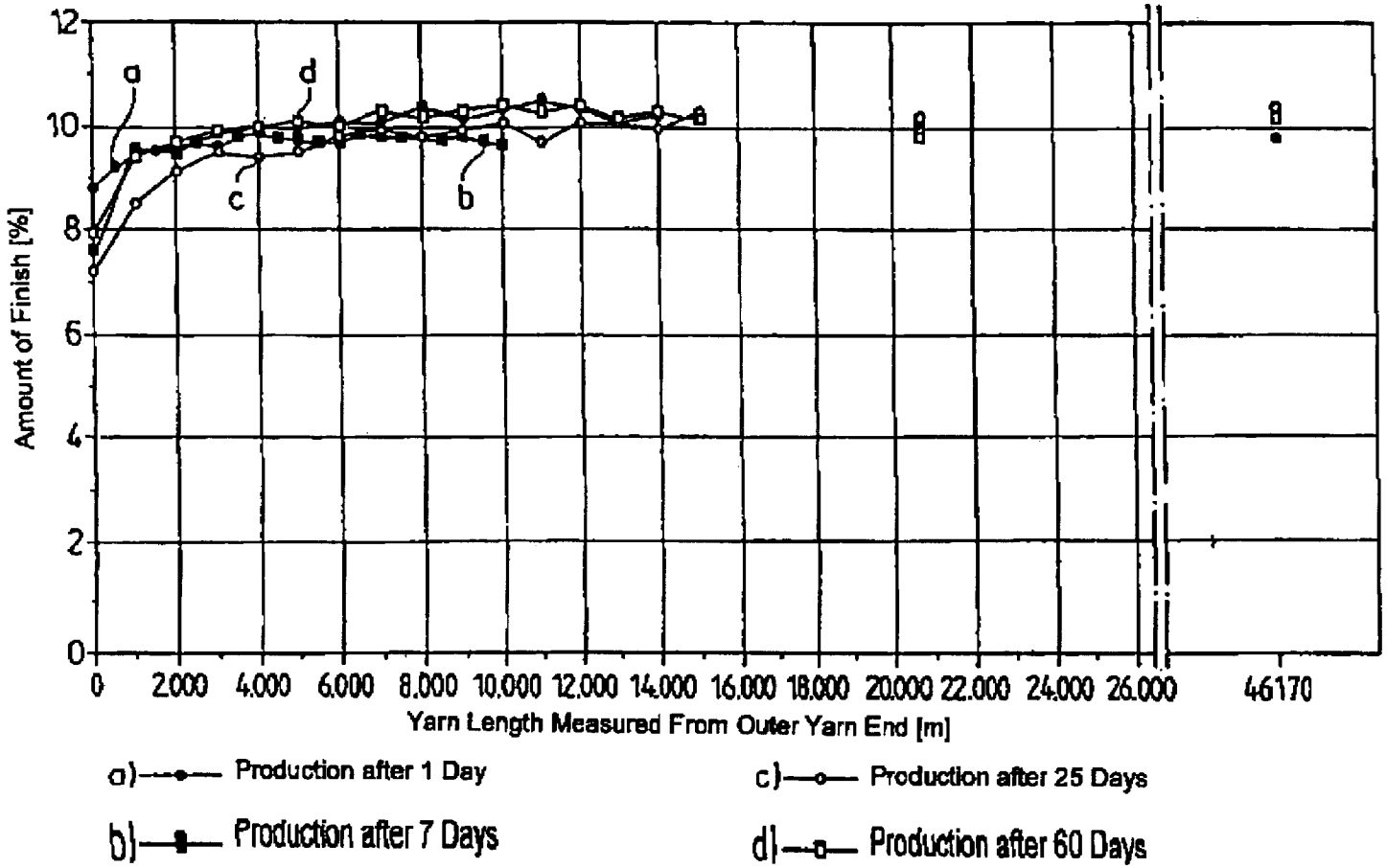
FIG. 5 is a graph as in FIG. 1 drawn up on the basis of four packages not according to the invention (titre 195 dtex)

The oil coat quantities reproduced in FIG. 5 are then measured along the run of the filament.

The table dimensions resulting when the packages are knitted after different storage periods are indicated in the following table:

| | Outside | Centre | Inside |
|---|---|---|---|
| Table dimension after 1 day package storage period | 11.2 cm | 11.5 cm | 11.5 cm |

-continued

| | Outside | Centre | Inside |
|---|---|---|---|
| Table dimension after 7 day package storage period | 11.0 cm | 11.6 cm | 11.6 cm |
| Table dimension after 25 day package storage period | 10.9 cm | 11.6 cm | 11.6 cm |
| Table dimension after 60 day package storage period | 10.9 cm | 11.6 cm | 11.6 cm |

Whereas the table dimension differences between inner and outer package layer are still comparatively moderate after a package storage period of one day, they also rise here to 0.7 cm after a longer storage period, so that there is also no guarantee that these packages produced according to the prior art can be perfectly processed after being stored for a lengthy period.

What is claimed is:

1. Elastane packages comprising elastane filaments having a titre of 100 to 350 dtex wound on cylindrical tubes, wherein the elastane filaments are provided with an outer coat of a finishing oil, and wherein the amount of finishing oil on the filaments of the outermost 3% of filaments wound on the cylindrical tubes is at least 1.2 times by weight the amount of finishing oil on the filaments of the innermost 20% of the package, the term "outermost" referring to the filaments furtherest from the core of the tube and the "innermost" referring to the filaments closest to the core of the tube.

2. Elastane package according to claim 1, wherein the elastane package is a pineapple elastane precision package produced according to the digicone method.

3. Elastane package according to claim 1, wherein the content of finishing oil on the outermost part of the package is increased with respect to the part of the innermost package filaments constituting at least 30%.

4. Elastane packages according to claim 1, wherein said contents of finishing oil are the amounts of oil applied to the surface of the filaments and wherein, 25 days after said application the content of finishing oil on the outermost 3% of filaments remains greater than that of the innermost 20% of the filament on the package.

5. Method for producing an elastane filament package comprising an outermost 3% of wound filament and an innermost 20% of wound filament wherein the amount of finishing oil on the filaments of the outermost 3% of wound filament is more than 1.2 times the amount of finishing oil on the filaments of the innermost 20% of wound filament and wherein said finishing oil is applied to filament to be wound onto said package, by spray finishing, a one-way finish or coating with finishing rolls, and wherein, when applying the finishing oil to the elastane filament, the last 3% of the filament, to be wound on the package, intended for the outer layer of the package, is provided with more than 1.2 times the amount of finishing oil as the filaments of the innermost 20% wound on the package.

6. Method according to claim 5, wherein the finishing oil is applied immediately after the elastane filaments have been spun.

7. Method for producing underwear, support garments bathing wear materials, hosiery bands, sock tops or elastic tape producing said underwear, support garments, bathing wear materials, hosiery bands, sock tops or elastane tape which comprises producing same with elastane filaments unwound from a cylindrical package on which elastane filament is wound, said elastane filament wound on said cylindrical package being coated with a finishing coat wherein the coating on the outermost 3% of filament wound on said cylindrical package amounts to more then 1.2 times by weight the amount of coating on the filament of the innermost 20% of filament wound on said package.

8. The elastane packages according to claim 1, wherein said outermost part constitutes at least 5%.

9. The elastane packages according to claim 8, wherein said outermost part constitutes at least 10%.

10. The elastane packages according to claim 1, wherein the content of finishing oil applied to the outermost part constitutes at least 1.5 times the content of finishing oil the surface of the inner region.

11. The elastane packages of claim 1, wherein the innermost part of filaments constitute at least 20% of the amount of filament on said package.

12. The elastane packages of claim 1, wherein said filaments have a titre of 130–270 dtex.

* * * * *